US009169053B2

(12) United States Patent
Sherman

(10) Patent No.: US 9,169,053 B2
(45) Date of Patent: Oct. 27, 2015

(54) PACKAGE DISPLAY CARD WITH DIE CUT SILHOUETTE PATTERN OF PRODUCT PROFILE

(71) Applicant: Plews, Inc., Dixon, IL (US)

(72) Inventor: Wesley T. Sherman, Dixon, IL (US)

(73) Assignee: Plews, Inc., Dixon, IL (US)

( * ) Notice: Subject to any disclaimer, the term of this patent is extended or adjusted under 35 U.S.C. 154(b) by 415 days.

(21) Appl. No.: 13/777,251

(22) Filed: Feb. 26, 2013

(65) Prior Publication Data

US 2014/0102932 A1 Apr. 17, 2014

Related U.S. Application Data

(60) Provisional application No. 61/713,964, filed on Oct. 15, 2012.

(51) Int. Cl.

| | |
|---|---|
| ***B65D 73/00*** | (2006.01) |
| ***B65D 75/36*** | (2006.01) |
| ***B65D 75/52*** | (2006.01) |

(52) U.S. Cl.

CPC ..... *B65D 75/366* (2013.01); *B65D 75/52* (2013.01); *B65D 2201/00* (2013.01)

(58) Field of Classification Search

CPC ... B65D 75/52; B65D 75/366; B65D 2201/00
USPC ..... 206/372, 373, 459.1, 459.5, 461, 462, 206/467, 471, 534
See application file for complete search history.

(56) References Cited

U.S. PATENT DOCUMENTS

| | | | | |
|---|---|---|---|---|
| 3,081,881 | A * | 3/1963 | Seeger | 211/85.3 |
| 3,770,120 | A * | 11/1973 | Hanson | 206/459.1 |
| 4,905,828 | A * | 3/1990 | Dods | 206/461 |
| 5,251,751 | A * | 10/1993 | Prussen | 206/459.5 |
| 5,941,394 | A * | 8/1999 | Siegler | 206/459.5 |
| 6,241,092 | B1 * | 6/2001 | Vasudeva | 206/372 |
| 2004/0222115 | A1 * | 11/2004 | Openiano | 206/372 |
| 2007/0256951 | A1 * | 11/2007 | O'Keefe | 206/461 |
| 2011/0233097 | A1 * | 9/2011 | Clark | 206/461 |

OTHER PUBLICATIONS

Dyna-Con Quick Couplings and Air Line Products, Foster Manufacturing Company, 2007, (16 pages).

* cited by examiner

*Primary Examiner* — Luan K Bui
(74) *Attorney, Agent, or Firm* — Bay Area Technology Law Group, P.C.

(57) ABSTRACT

A product package includes a generally flat hang card with an enclosed product chamber and at least one lateral edge with a two dimensional profile cut pattern of a product in the package which enables a prospective customer the opportunity to compare the profile of a sample product to determine the compatibility of the sample with the packaged product or to confirm the content of the package without opening the package.

4 Claims, 4 Drawing Sheets

PACKAGE DISPLAY CARD WITH DIE CUT SILHOUETTE PATTERN OF PRODUCT PROFILE

CROSS REFERENCE TO RELATED APPLICATION

This is a utility application incorporating by reference and claiming priority to provisional application Ser. No. 61/713,964 filed Oct. 15, 2012 entitled "Package Display Card With Die Cut Silhouette Pattern of Product Profile".

BACKGROUND OF THE INVENTION

In a principal aspect, the present invention relates to a product package construction for displaying the product maintained, in the package while further incorporating a feature which enables a prospective purchaser of the packaged product to confirm that the packaged product is compatible with a sample of a related item maintained by the prospective purchaser without removing the packaged product from the package.

Many products are packaged in packaging such as a display pack comprised of a generally flat cardboard backing with a clear plastic cover adhered to the backing. The plastic cover retains the product on the backing. The cardboard backing typically includes a slot or opening near the top edge so that the packaged product may be supported on a display hook. Thus multiple packages of the identical packaged item or product may be supported on a single display hook. Often, similar products are displayed in an array of multiple hooks on a display rack. As a consequence, customers searching for a particular item in such a display may, as a result of inspecting the packaged products, remove display items temporarily and then replace them improperly on a display hook. Consequently, a subsequent customer may mistakenly choose a displayed, packaged item or may be challenged to confirm that the correct item is available or being chosen for purchase. This is a problem which can be especially frustrating in the circumstance where the display rack array involves products that are similar with subtle, but important differences.

For example, various fasteners, air hose couplers, hardware items and many other products may be difficult to easily distinguish. In an effort to overcome this problem, the products involved may be retained in clear plastic blister packaging. That is, the cardboard backing for the product may include a clear plastic bubble shaped cover for the product which enables the customer to see the potential purchase. Further the cardboard backing may include descriptive printing, product names and other legends to assist product choice. Nonetheless, customers may be challenged to make the correct purchase choice even if the customer has a sample of the desired product for visual comparison purposes.

Thus there has developed the need to provide a package construction which will assist a customer making a desired product choice.

SUMMARY OF THE INVENTION

Briefly the present invention comprises a package construction which incorporates a backing or panel having a silhouette that matches the profile of the product maintained in the package or is correlated with a compatible specimen product available to and used by the prospective purchaser to confirm the relationship between the specimen product and packaged product. By way of example, a generally flat, package panel may include a side edge with a profile cut pattern of the packaged product. More specifically, a backing card may include two intersecting sides. One such side further includes a profile cut pattern of a packaged product having a centerline axis of symmetry wherein the cut pattern matches the entire axial length profile of the packaged product along at least the one side which terminates substantially at the intersection with the other side. Thus a customer having a particular sample product, such as an air hose coupler plug, may physically match the plug with the cut profile in the product backing card to thereby confirm that the packaged product is the same as or is compatible with the specimen or sample product provided by the customer.

Other embodiments of the invention include one or more additional features such as (1) a three dimensional pattern in a plastic blister or bubble incorporated in the package and (2) a two dimensional silhouette profile of two sides of a product wherein two profiles or patterns are cut in the sides of the packaging material, and (3) printed silhouettes on the packaging material, and (4) color coding of the correlation of the packaged product with a specimen sample product.

Thus an aspect and object of the invention is to provide a means and product package construction which enables ascertainment and confirmation of the identity of a packaged product.

Another aspect, feature and object of the invention is to provide a package product and system which enables a potential consumer to confirm that a packaged item is compatible with one or multiple components in the possession of the customer without removing the packaged item from the package.

Another object, feature and aspect of the invention is to provide a package for a product which enables a potential consumer to confirm by visual inspection of the package that the packaged product is compatible with a specimen item which the consumer provides without opening the package to physically touch and inspect the packaged product.

A further feature, aspect and object of the invention are to provide an improved product package which is inexpensive and enables identity and confirmation of the packaged item.

These and other objects, advantages, aspects and features of the invention are set forth in the detailed description which follows.

BRIEF DESCRIPTION OF THE DRAWING

In the detailed description which follows reference is made to the following figures.

DESCRIPTION OF EMBODIMENTS OF THE INVENTION

Figure 1:
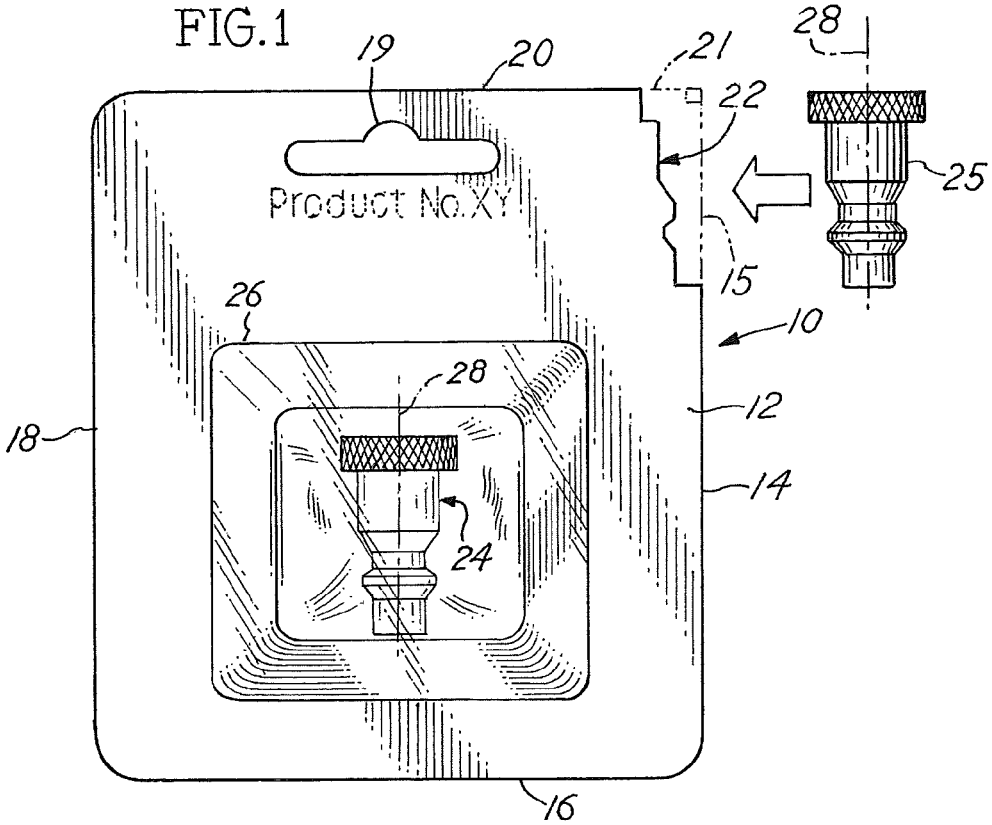
FIG. 1 is a plan view of a product hang card for air hose plug illustrating a two dimensional embodiment of the invention.
Figure 2:
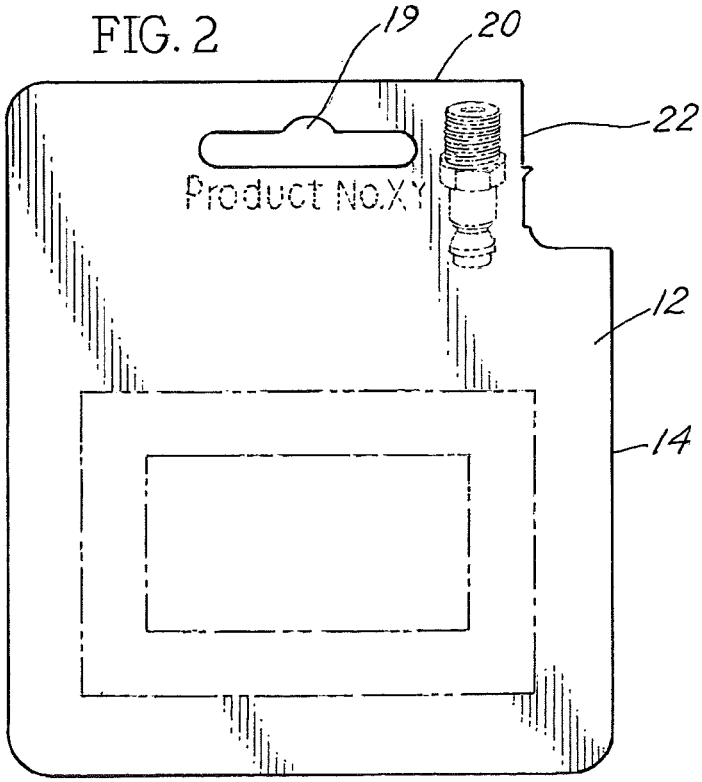
FIG. 2 is a plan view of a product hand card for a different air hose plug illustrating a two dimensional embodiment of the invention.
Figure 3:
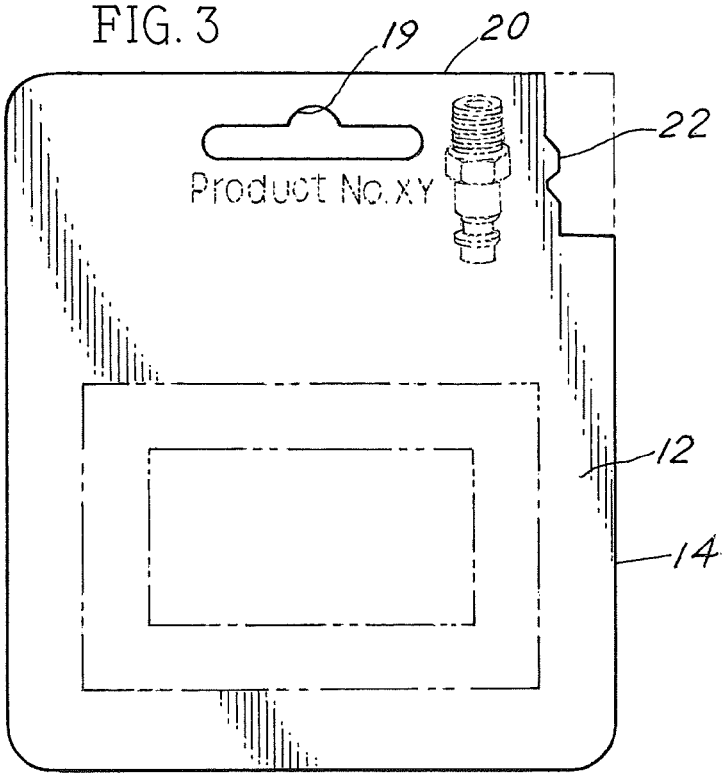
FIG. 3 is a plan view of a product hand card for a different air hose plug illustrating a two dimensional embodiment of the invention.
Figure 4:
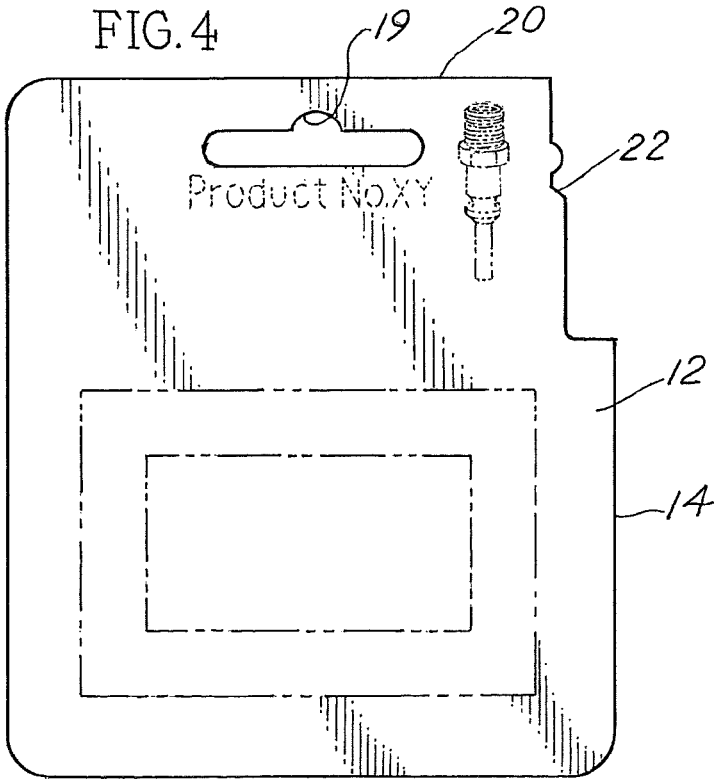
FIG. 4 is a plan view of a product hand card for a different air hose plug illustrating a two dimensional embodiment of the invention.
Figure 5:
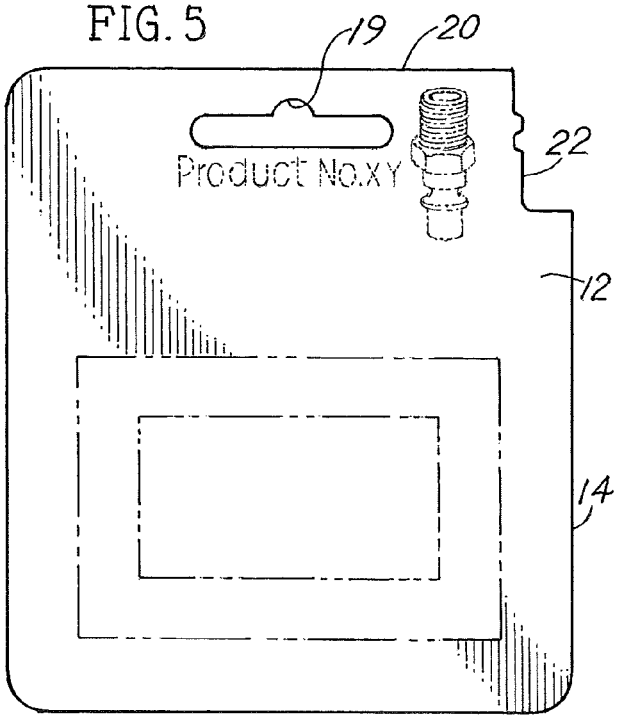
FIG. 5 is a plan view of a product hang card illustrating an alternate two dimensional embodiment of the invention.
Figure 6:
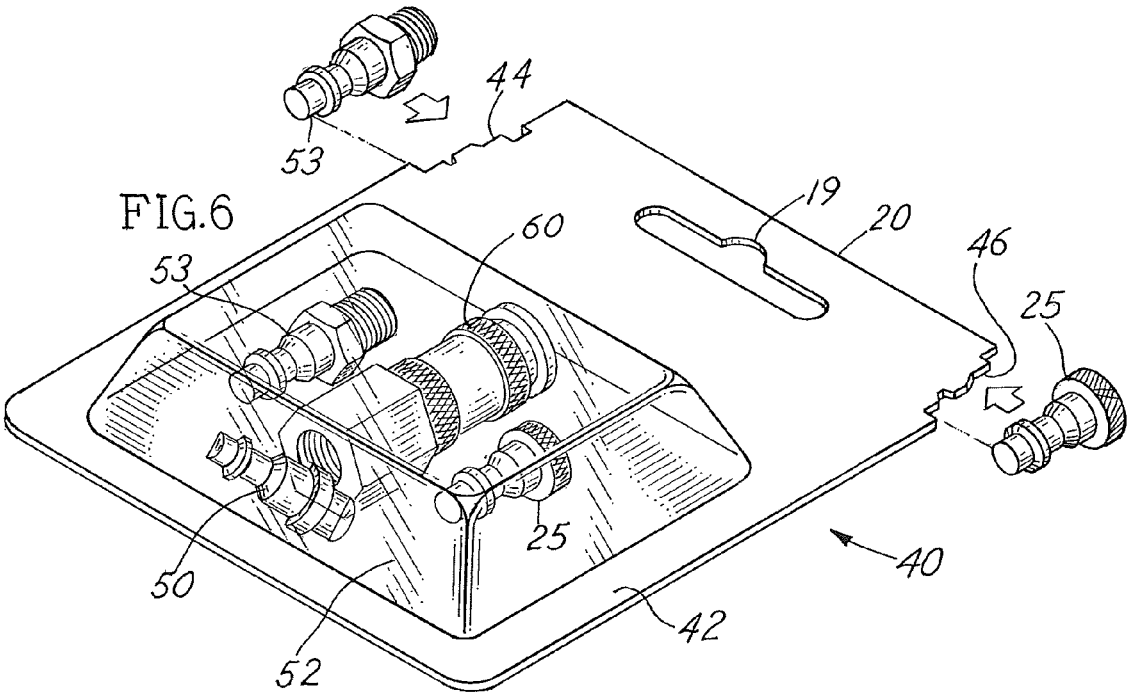
FIG. 6 is an isometric view of an embodiment of the invention.
Figure 7:
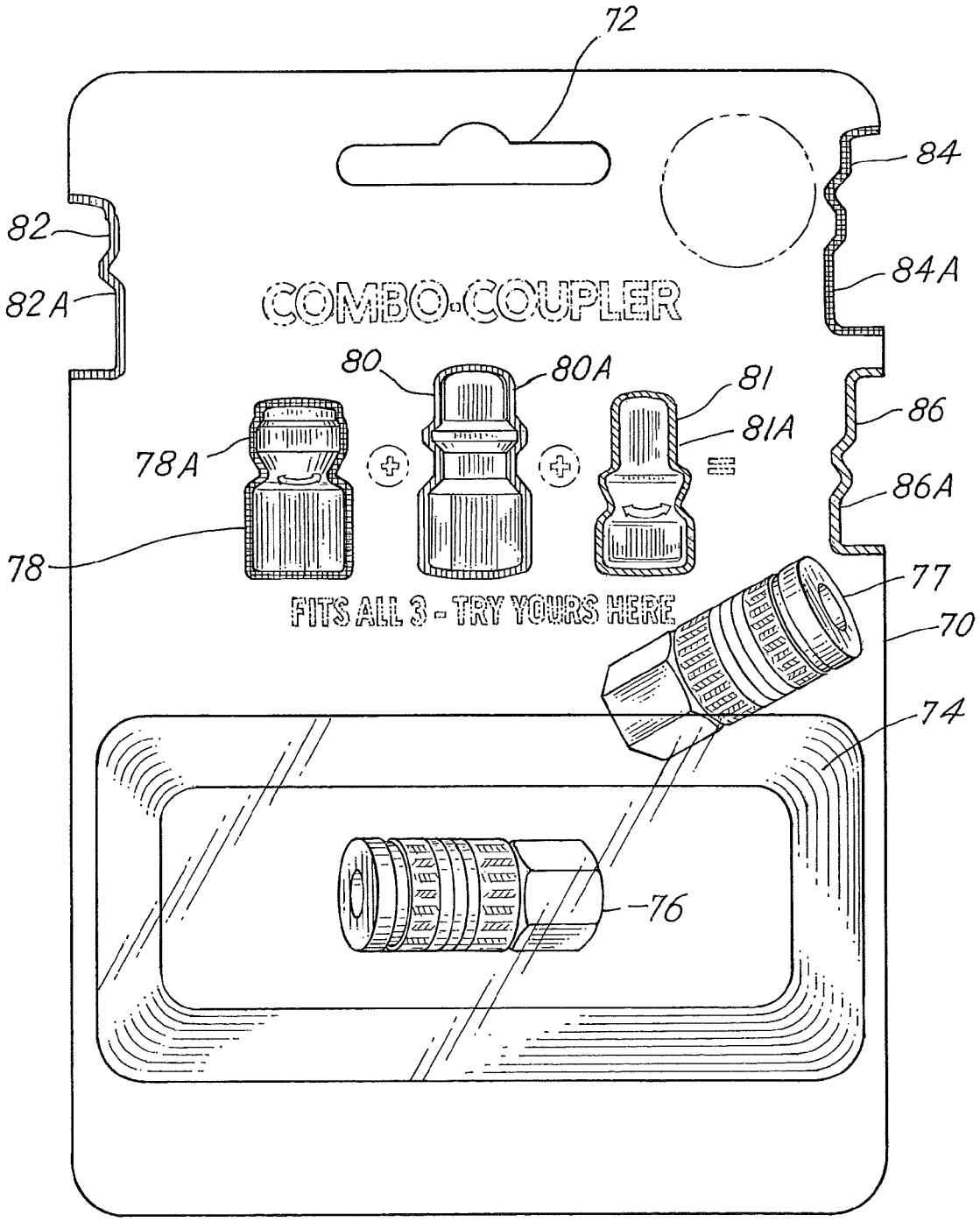
FIG. 7 is an isometric view of a further embodiment of the invention.

FIG. 1 and companion FIGS. 2-5 depict two dimensional product identification versions of the invention. FIG. 6 depicts a package with a three dimensional identification feature. FIG. 7 depicts another alternative embodiment of the invention.

Thus referring to the Figures, a product package 10 includes a cardboard backing card 12 which has a generally rectangular configuration with intersecting sides 14, 16, 18, 20. Straight line extensions 15, 21 of the two sides 14, 20 intersect at a right angle. A cut profile pattern 22 is defined by the intersecting sides 14, 20. The cut profile pattern 22 is associated with a product 24 retained in a clear, plastic bubble 26 mounted on and adhered to card 12.

For example, packaged product 24, as depicted, is an air hose plug 24 which is designed to be inserted in a coupler (not shown) to connect an air hose to a tool or the like. The plug 24 is generally symmetrical about a centerline axis 28. The lateral side 30 of the plug 24 defines a profile or configuration or silhouette. That profile or configuration is substantially identical to the cut profile or pattern 22 in card 12. Thus a customer who desires to confirm that the product (plug) 24 is the same as a sample or specimen 25 which the customer has may fit the specimen or sample product 25 in the cut profile 22 to make such a confirmation. Importantly, extension 15 of the side 14 coincides generally with the axis of symmetry 28 of plug 25 which may be fitted in profile 22. Further, the axial extent of the extension 15 is typically substantially equal to the length of the plug 25 and the profile 22 is shaped to accommodate the maximum transverse dimension of the hexagonal head of product 25 since that dimension varies because of the hexagonal shape. This arrangement insures the match between the packaged product 24 and a customer sample or specimen product 25.

A packaged product may also be a device which is compatible with the specimen product 25 of a customer. For example, a coupler 60 in FIG. 6 compatible with specimen product 25 may be maintained in the package by cover 52 in FIG. 6. Matching the plug profile of the specimen product 25 with profile 46 will enable confirmation of the compatibility of plug 25 and coupler 60 in the package of FIG. 6 without opening the package. Alternatively, the package may contain only the coupler 60 and by matching patterns or silhouette 44, 46 with compatible plug 25 and 53 in FIG. 6, the potential purchaser acquires confirmation of compatibility of the coupler 60 with plugs 25 and 53. Confirmation of compatibility is thus accomplished without opening the package cover 52.

Multiple variations of the two dimension product profile component are available. For example, the profile may be provided for only a portion of the packaged product. Thus, the head portion of a packaged product such as a knob or other hardware item may be provided. Fasteners are also products of the type susceptible of packaging of the type described. For example, fasteners such as a bolt may comprise a customer specimen item. The package may contain a combination of such bolts, compatible nuts, or compatible washers, or any combination of such compatible component parts. Consequently, the customer specimen product and package design as described, in combination, enable the correlation of multiple types of specimen hardware or other items with packaged goods without removing the goods from the package.

As depicted in FIG. 6, multiple products may be packaged in a blister pack package 40. In such event multiple product profiles may be included in and on a backing card 42 by a cover 52, for example the cut profiles 44, 46. Additionally, the profiles 44, 46 may represent alternative or distinct section profiles of a product such as hardware or a semi-symmetric product. Further the cut profile pattern may be incorporated in a product tag attached to a product package. Also as depicted in FIG. 6, the package may be constructed by providing a three dimensional profile pattern 50 molded in a plastic blister pack cover 52.

FIG. 7 depicts a further variation of the package invention. In FIG. 7, a backing card 70 includes a hang slot 72 and a clear plastic enclosure 74 adhered to card 70. The card 70 also includes printing. in this instance, the printing depicts a coupler for an air hose; namely, a coupler 76. A coupler 76 is the item encapsulated or enclosed by the plastic enclosure or cover 74 and is also illustrated as a printed item 77 on the card 70.

Further, because the coupler 76 is, in this example, a universal coupler, it is capable of compatible joinder with any one of three plugs depicted as printed items 78, 80 and 81. Further, the card 70 may include a series of cut silhouettes 82, 84, 86 which are bordered by a color code, for example, silhouette 84 associated with color code yellow 84A associated with the printed plug item 80 surrounded by or outlined by yellow color code 80A. Similarly, the card 70 includes a second cut silhouette; namely, a silhouette 86 with a red outline 86A associated with the print plug 81 and red border or outline 81A. A third silhouette may be provided, for example, on card 70; namely, a profile section 82 which includes a green border 82A associated with the printed plug item 78 and green border 78A. Typically the printed item, e.g. 81, will be the size and shape of the physical embodiment, but that is not a limitation of the concept since size may be varied as desired.

Using these various visual and physical features of the card 70, a prospective customer that is looking for a universal coupler 76 packaged in enclosure 74 may verify that a plug (printed item 78, 80 or 81) that a customer is carrying as a specimen or sample matches a compatible coupler cut silhouette 82, 84, 86 provides additional confirmation of a match. In this manner, the necessity to open the package by removing the plastic cover 74 is totally avoided. The customer may thus have a number of alternative means associated merely with the packaging of the packaged item 76 to verify the compatibility thereof and identification thereof. The feature of compatibility with respect to a specimen product or item may, therefore, be used with multiple types of cooperative components such as bolts, nuts, washers, screws, couplers, plugs and the like.

Consequently, while multiple embodiments of the invention have been disclosed the invention is to be limited only by the following claims and equivalents. By way of example, but not limitation, the orientation of the sides of a backing card may be altered. The number and configuration of the profiles per package may be varied. The combinations of profiles, color coding, printed patterns of the packaged goods and the relationship of the packaged goods to a customer specimen may be varied to accomplish improved product identity and selection by a consumer. Further the products may be packaged in multiple types of containers using the labeling and identification techniques described including boxes, sacks with attached identity cards, blister packaged, and plastic packaging among others. Further the profile pattern may be cut or formed through the interior of a card, for example, the profile of plug 78 in FIG. 6 may be cut out of card 70 or may be susceptible of being punched out of the card 70. The package materials may be varied. A separate profile card may be attached to the product package.

What is claimed is:

1. A product and packaging for said product, said product having an exterior surface, a top, a bottom, a geometric center and a longitudinal axis extending between said top and bottom located at the product's geometric center and a profile defining the exterior surface of said product between said top and bottom, said package comprising a backing and substantially transparent enclosure which, in combination, secure said product within said packaging, said packaging having a periphery and further comprising a plurality of edges defining said periphery, at least one of the edges being substantially linear, said substantially linear edge further comprising a silhouette region such that when said product is mated to said silhouette region by aligning said longitudinal axis with said substantially linear edge, said profile is coincident with said silhouette region.

2. The product and packaging for said product of claim 1 wherein said packaging comprises a generally flat cardboard backing with substantially transparent cover thereover.

3. A primary product and packaging for said primary product, said primary product being capable of being joined to a secondary product, said secondary product having an exterior surface, a top, a bottom, a geometric center and a longitudinal axis extending between said top and bottom located at the secondary product's geometric center and a profile defining the exterior surface of said secondary product between said top and bottom, said package comprising a backing and substantially transparent enclosure which, in combination, secure said primary product within said packaging, said packaging having a periphery and further comprising a plurality of edges defining said periphery, at least one of the edges being substantially linear, said substantially linear edge further comprising a silhouette region such that when said secondary product is mated to said silhouette region by aligning said longitudinal axis with said substantially linear edge, said profile is coincident with said silhouette region.

4. The product and packaging for said product of claim 3 wherein said primary product also has an exterior surface, a top, a bottom, a geometric center and a longitudinal axis extending between said top and bottom located at the primary product's geometric center and a profile defining the exterior surface of said primary product between said top and bottom, the periphery of said package further comprising a second silhouette region such that when said primary product is mated to said second silhouette region by aligning said longitudinal axis with said periphery, said profile is coincident with said second silhouette region.

* * * * *